US005569531A

United States Patent [19]

Ohiwa et al.

[11] Patent Number: 5,569,531

[45] Date of Patent: Oct. 29, 1996

[54] INK RIBBON

[75] Inventors: Tsunemi Ohiwa, Osaka; Yoshinori Yamamoto, Takatsuki, both of Japan

[73] Assignee: Hitachi Maxell, Ltd., Osaka, Japan

[21] Appl. No.: 318,117

[22] Filed: Oct. 5, 1994

[30] Foreign Application Priority Data

Oct. 5, 1993 [JP] Japan ..... 5-274937

[51] Int. Cl.[6] ..... B41M 5/26

[52] U.S. Cl. ..... 428/323; 428/195; 428/206; 428/336; 428/690

[58] Field of Search ..... 428/195, 207, 428/690, 323, 206, 336; 106/21 R

[56] References Cited

U.S. PATENT DOCUMENTS 4,202,491 5/1980 Suzuki ..... 235/491

5,478,381 12/1995 Ohiwa et al. ..... 106/21 R

FOREIGN PATENT DOCUMENTS 53-9607 1/1978 Japan .
53-9600 1/1978 Japan .
54-22326 8/1979 Japan .
61-18231 5/1986 Japan .

*Primary Examiner*—Pamela R. Schwartz
*Attorney, Agent, or Firm*—Birch, Stewart, Kolasch & Birch, LLP

[57] ABSTRACT

An ink ribbon comprising a base film and an ink layer having a thickness of from 1 to 10 μm and containing a particle form infrared ray-emitting fluorescent substance having excellent light emitting characteristics.

7 Claims, No Drawings

INK RIBBON

BACKGROUND OF THE INVENTION

1. Field of the Invention

The present invention relates to an ink ribbon comprising an infrared ray-emitting fluorescent substance which is excited by infrared ray and emits light in the infrared region. In particular, the present invention relates to an ink ribbon having an ink layer which contains a fine particle form infrared ray-emitting fluorescent substance having excellent light-emitting characteristics.

2. Description of the Related Art

To prevent forgery and keep secrecy, an infrared ray-emitting layer which is not be visible to the naked eye, such as a stealth bar code, is heat transferred on a printed material such as a brochure or catalogue using an ink ribbon comprising an infrared ray-emitting fluorescent substance which emits light in the infrared region (see Japanese Patent KOKAI Publication Nos. 9607/1978 and 22326/1979) and the code information is read by an apparatus for optically reading to obtain information of goods such as properties and a price or varied personal information (see Japanese Patent KOKAI Publication No. 9600/1978). It has been tried to heat transfer an infrared ray-emitting layer on a plastic substrate such as a prepaid card, an ID card and a magnetic card, or a magnetic layer using such an ink ribbon. However, an infrared ray-emitting fluorescent substance which is conventionally used in the ink ribbon has a large particle size. For example, a phosphorus base infrared ray-emitting fluorescent substance of the formula:

$$QD_{1-x-y}Nd_xYb_yP_4O_{12}$$

wherein Q is at least one element selected from the group consisting of Li, Na, K, Rb and Cs; D is at least one element selected from the group consisting of Sc, Y, La, Ce, Gd, Lu, Ga and In; x is a number of 0.05 to 0.999 and y is a number of 0.001 to 0.95, provided that a sum of x and y (x+ y) is 1.0 or less is disclosed in Japanese Patent Publication No. 40594/1978) and often used but its particle size is 7 μm or larger.

Because of such large particle size, it should be ground to a particle size of 0.1 to 2 μm when it is used in the ink ribbon. But, by grinding, crystallinity or composition of the infrared ray-emitting fluorescent substance is deteriorated and the particle shape becomes a needle shape so that the particle size distribution is broadened and dispersibility is worsened, whereby the dispersing apparatus is damaged. In addition, the intensity of the emitted light is greatly decreased and duration of afterglow is shortened. Accordingly, such infrared ray-emitting fluorescent substance may not be practically used when a thickness of the ink ribbon is 1 to 10 μm.

SUMMARY OF THE INVENTION

One object of the present invention is to provide an ink ribbon comprising an infrared ray-emitting fluorescent substance, which can overcome the above problems of the conventional infrared ray-emitting fluorescent substance.

Another object of the present invention is to provide an ink ribbon which comprises a fine particle form infrared ray-emitting fluorescent substance having a high light emitting intensity and is excellent in light-emitting characteristics.

According to the present invention, there is provided an ink ribbon comprising a base film and an ink layer which has a thickness of 1 to 10 μm and contains a particle form infrared ray-emitting fluorescent substance.

In a preferred embodiment, the ink layer contains, as a particle form infrared ray-emitting fluorescent substance having a high light emitting intensity and long duration of afterglow, an infrared ray-emitting fluorescent substance of the formula:

$$A_{1-x-y}Nd_xYb_yPO_4 \quad (I)$$

wherein A is at least one element selected from the group consisting of Al, Bi, B, In, Ga, Sc, Gd, Ce, Y, Lu and La, x is a number of 0 to 0.9, and y is a number of 0 to 0.9, provided that a sum of x and y is larger than 0 and not larger than 1, or the formula:

$$A_{2-p-q}Nd_pYb_qCa_5(MoO_4)_8 \quad (II)$$

wherein A is the same as defined above, p is a number of 0 to 2, and q is a number of 0 to 2, provided that a sum of p and q is larger than 0 and not larger than 2, whereby the ink layer is excellent in the light emitting characteristics.

In another preferred embodiment, the ink layer contains at least one compound selected from the group consisting of alkylamines and phosphate salts as a dispersant, whereby the infrared ray-emitting substance particles are well dispersed in the ink layer and, as a result the light emitting characteristics are further improved.

DETAILED DESCRIPTION OF THE INVENTION

In the present invention, the infrared ray-emitting fluorescent substance is used in a particle form.

Preferred examples of the infrared ray-emitting fluorescent substance are a phosphoric acid base infrared ray-emitting fluorescent substance of the formula:

$$A_{1-x-y}Nd_xYb_yPO_4 \quad (I)$$

wherein A is at least one element selected from the group consisting of Al, Bi, B, In, Ga, Sc, Gd, Ce, Y, Lu and La, x is a number of 0 to 0.9, and y is a number of 0 to 0.9, provided that a sum of x and y is larger than 0 and not larger than 1, and a molybdic acid base infrared ray-emitting fluorescent substance of the formula:

$$A_{2-p-q}Nd_pYb_qCa_5(MoO_4)_8 \quad (II)$$

wherein A is the same as defined above, p is a number of 0 to 2, and q is a number of 0 to 2, provided that a sum of p and q is larger than 0 and not larger than 2.

A particle size of the infrared ray-emitting fluorescent substance is preferably at least 0.1 μm and less than 1 μm.

Since the thickness of the ink layer is from 1 to 10 μm, when the particle size is less than 0.1 μm, the number of the particles in a unit volume increases while a sufficient intensity of the emitted light is not achieved because of the small intensity of the emitted light from each particle.

When the particle size is 1 μm or larger, the total number of the particles to be contained in the ink layer is small and the density per unit surface area decreases, so that sufficient intensity of the emitted light is not achieved. Further, the shape of each particle appears on the surface of the ink layer, so that an ink layer having a uniform and smooth surface cannot be obtained.

The above phosphoric acid base infrared ray-emitting fluorescent substance (I) may be prepared by mixing orthophosphoric acid or a phosphate salt of the formula:

$$M_{3-z}H_zPO_4 \quad \text{(III)}$$

wherein M is at least one metal element selected from the group consisting of alkali metals and alkaline earth metals and z is a number of 0 to less than 3 with a raw material powder containing a compound of at least one element selected from the group consisting of Nd and Yb and optionally a compound of at least one element selected from the group consisting of Al, Bi, B, In, Ga, Sc, Gd, Ce, Y, Lu and La, sintering the mixture, air cooling the mixture, and hydrothermally treating it at a temperature of 50° C. or higher to remove impurities such as excessive phosphate salts. This method can produce the infrared ray-emitting fluorescent substance having a particle size of less than 1 μm and a very high light emitting intensity, which can be contained in the ink layer of the ink ribbon without grinding.

The molybdic acid base infrared ray-emitting fluorescent substance (II) may be prepared by mixing molybdenum oxide and calcium carbonate with a raw material powder containing a compound of at least one element selected from the group consisting of Nd and Yb and optionally a compound of at least one element selected from the group consisting of Al, Bi, B, In, Ga, Sc, Gd, Ce, Y, Lu and La, sintering the mixture, air cooling the mixture, and hydrothermally treating it at a temperature of 50° C. or higher to remove impurities such as excessive molybdenum oxide. As in the case of the phosphoric acid base infrared ray-emitting fluorescent substance, this method can produce the infrared ray-emitting fluorescent substance having a particle size of less than 1 μm and a very high light emitting intensity, which can be contained in the ink layer of the ink ribbon without grinding.

When the above phosphoric acid or molybdic acid base infrared ray-emitting fluorescent substance is used in the ink ribbon, the ink ribbon has a high light emitting intensity and good light emitting characteristics.

The above phosphoric acid or molybdic acid base infrared ray-emitting fluorescent substance emits infrared ray through the forbidden transition of the 4f electrons of Nd and/or Yb. The reason why the light emitting intensity is high though the particle size is small, the crystallinity of the orthophosphate salt or molybdate salt as a base material is high and further the substance can contain a large amount of Nd and/or Yb so that the crystallinity is improved.

Orthophosphoric acid and the phosphate salt (III) may be used independently or in combination thereof. To achieve the high light emitting intensity, the phosphate salt (III) wherein x is large is preferably used.

Molybdenum oxide is used as one of the raw materials of the molybdic acid base infrared ray-emitting fluorescent substance.

As the compounds of Nd and/or Yb, their oxides, chlorides, carbonates, nitrates and acetates are preferably used. As the compounds of Al, Bi, B, In, Ga, Sc, Gd, Ce, Y, Lu and La, their oxides, chlorides, carbonates, nitrates and acetates are preferably used.

The sintering is carried out by charging the raw materials and compounds in a crucible and heating them at a temperature of 400° to 1500° C., preferably 500° to 1000° C. in an air for 0.5 to 6 hours.

The amount of the infrared ray-emitting fluorescent substance is preferably from 30 to 90% by weight, more preferably from 60 to 85% by weight based on the weight of the ink layer.

When the particle form infrared ray-emitting fluorescent substance having the very high light emitting intensity is used in combination with a dispersant, the dispersibility is improved so that the light emitting intensity is further increased.

As the dispersant, an alkylamine or a phosphate salt can be used. When the dispersant is contained in the ink layer, it adheres to particle surfaces of the infrared ray-emitting fluorescent substance and improves affinity to a binder resin to disperse the fluorescent substance well in the binder resin.

The alkylamine and the phosphate salt may be used independently or in combination thereof. As the alkylamine, one having 12 to 18 carbon atoms is preferably used. As the phosphate salt, methacryloyl phosphate is preferably used.

An alkyl group of the alkylamine may be a straight or branched one. The alkyl group may have an unsaturated group or an aromatic group.

Specific examples of the alkylamine are dodecylamine, stearylamine, myristylamine, etc. Among them, dodecylamine is preferred in view of dispersibility.

Specific examples of the phosphate salt are mono(2-acryloyloxyethyl) acid phosphate, mono(2-methacryloyloxyethyl) acid phosphate, diphenyl-2-methacryloyloxyethyl phosphate, etc. Among them, methacryloyl phosphates are preferred in view of dispersibility.

An amount of the alkylamine and/or the phosphate salt is from 0.1 to 5% by weight based on the weight of the infrared ray-emitting fluorescent substance, since the dispersibility of the fluorescent substance is not sufficiently improved when this amount is less than 0.1% by weight, while the fluorescent substance is reagglomerated or powder drops when this amount exceeds 5% by weight.

As the binder resin of the ink layer, a fusible binder resin can be used. Examples of the binder resin are haze wax, bees wax, synthetic wax, polyurethane resin, polyester resin, vinyl chloride base resin, and the like.

The ink ribbon of the present invention may be produced by any of conventional methods. For example, the particle form infrared ray-emitting fluorescent substance is mixed and dispersed in the fusible binder resin and optionally the dispersant to prepare an ink composition, and then the ink composition is coated on a conventionally used base film such as a polyethylene terephthalate film and the like and dried to form the ink layer having the thickness of 1 to 10 μm.

The thickness of the ink layer is preferably from 1 μm to 10 μm, more preferably from 1 μm to 5 μm. When this thickness is less than 1 μm, an output is too small. When this thickness exceeds 10 μm, the ink layer itself becomes brittle so that it tends to peel off.

When the ink layer is heat transferred from the ink ribbon onto a sheet of paper, a plastic substrate or a magnetic layer, a printed material such as a catalogue, a prepaid card, an ID card or a magnetic card on which an information invisible to the naked eyes such as a stealth bar cord is printed is obtained.

The ink layer may contain a pigment or dye except carbon black which absorbs the infrared ray, such as Lake Red C (a red organic pigment), phthalocyanine blue (a blue organic pigment), etc.

PREFERRED EMBODIMENTS OF THE INVENTION

The present invention will be illustrated by the following examples, in which "parts" are by weight unless otherwise indicated.

EXAMPLE 1

The following components were well mixed and charged in an aluminum crucible having a lid:

| Component | Parts |
|---|---|
| Lithium dihydrogenphosphate ($LiH_2PO_4$) | 260.0 |
| Neodymium oxide ($Nd_2O_3$) | 9.4 |
| Ytterbium oxide ($Yb_2O_3$) | 10.9 |
| Yttrium oxide ($Y_2O_3$) | 50.2 |

The crucible was heated from room temperature to 750° C. at a constant heating rate over 2 hours and sintered at 750° C. for 2 hours in an electric furnace.

After sintering, the crucible was removed from the electric furnace and cooled in an air. Then, hot water of 100° C. was poured in the crucible and boiled. Thereafter, a formed substance was recovered from the crucible and washed with 1N nitric acid and then with water, followed by drying to obtain an infrared ray-emitting fluorescent substance, which had a particle size of 0.5 μm and a composition of $Nd_{0.1}Yb_{0.1}Y_{0.8}PO_4$.

The obtained infrared ray-emitting fluorescent substance (60 parts), bees wax (40 parts) and dodecylamine (5 parts) were molten and mixed to obtain an ink composition.

The ink composition was coated at a dry thickness of 2 μm on a polyethylene terephthalate film having a thickness of 5 μm and dried to form an ink layer and obtain an ink ribbon.

Then, the ink layer was heat transferred from the ink ribbon onto a sheet of paper.

EXAMPLE 2

In the same manner as in the preparation of the infrared ray-emitting fluorescent substance in Example 1 except that yttrium oxide was not used, an infrared ray-emitting fluorescent substance was prepared. The obtained infrared ray-emitting fluorescent substance had a particle size of 0.6 μm and a composition of $Nd0.5Yb0.5PO_4$.

In the same manner as in the production of the ink ribbon in Example 1 except that the above prepared infrared ray-emitting fluorescent substance ($Nd0.5Yb_{0.5}PO_4$) was used, an ink ribbon was produced.

Then, the ink layer was heat transferred from the ink ribbon onto a sheet of paper.

EXAMPLE 3

The infrared ray-emitting fluorescent substance prepared in Example 1 ($Nd0.1Yb_{0.1}Y_{0.8}PO_4$; particle size of 0.5 μm) (80 parts), a polyurethane resin (UR 8200 manufactured by Toyobo Co., Ltd.) (10 parts), a polyester resin (Nipporan N 930 manufactured by Nippon Polyurethane Industries, Ltd.) (8 parts), an ethylene-vinyl alcohol resin (Evaflex 210 manufactured by Mitsui DuPont Co., Ltd.) (2 parts), diphenyl-2-methacryloyloxyethyl phosphate (2 parts), methyl ethyl ketone (150 parts) and toluene (100 parts) were mixed and dispersed in a sand mill for 1 hour to obtain an ink composition.

The ink composition was coated at a dry thickness of 1.5 μm on a polyethylene terephthalate film having a thickness of 5 μm and dried to form an ink layer and obtain an ink ribbon.

Then, the ink layer was heat transferred from the ink ribbon onto a sheet of paper. The transferred ink layer had good abrasion resistance and chemical resistance.

EXAMPLE 4

In the same manner as in Example 3 except that the infrared ray-emitting fluorescent substance ($Nd_{0.5}Yb_{0.5}PO_4$) prepared in Example 2 was used, an ink composition was prepared and an ink ribbon was produced.

Then, the ink layer was heat transferred from the ink ribbon onto a sheet of paper. The transferred ink layer had good abrasion resistance and chemical resistance.

EXAMPLE 5

In the same manner as in Example 1 except that the same amount of diphenyl-2-methacryloyloxyethyl phosphate as that of dodecylamine was used in place of dodecylamine in the preparation of the ink composition, an ink composition was prepared and an ink ribbon was produced.

Then, the ink layer was heat transferred from the ink ribbon onto a sheet of paper.

EXAMPLE 6

In the same manner as in Example 3 except that the same amount of diphenyl-2-methacryloyloxyethyl phosphate as that of dodecylamine was used in place of dodecylamine in the preparation of the ink composition, an ink composition was prepared and an ink ribbon was produced.

Then, the ink layer was heat transferred from the ink ribbon onto a sheet of paper. The transferred ink had good abrasion resistance and chemical resistance.

EXAMPLE 7

In the same manner as in Example 1 except that dodecylamine was not used in the preparation of the ink composition, an ink composition was prepared and an ink ribbon was produced.

Then, the ink layer was heat transferred from the ink ribbon onto a sheet of paper.

EXAMPLE 8

In the same manner as in Example 2 except that dodecylamine was not used in the preparation of the ink composition, an ink composition was prepared and an ink ribbon was produced.

Then, the ink layer was heat transferred from the ink ribbon onto a sheet of paper.

EXAMPLE 9

In the same manner as in Example 3 except that diphenyl-2-methacryloyloxyethyl phosphate was not used in the preparation of the ink composition, an ink composition was prepared and an ink ribbon was produced.

Then, the ink layer was heat transferred from the ink ribbon onto a sheet of paper. The transferred ink had good abrasion resistance and chemical resistance.

EXAMPLE 10

In the same manner as in Example 4 except that diphenyl-2-methacryloyloxyethyl phosphate was not used in the preparation of the ink composition, an ink composition was prepared and an ink ribbon was produced.

Then, the ink layer was heat transferred from the ink ribbon onto a sheet of paper. The transferred ink had good abrasion resistance and chemical resistance.

EXAMPLE 11

In the same manner as in Example 1 except that the ink composition was coated at a dry thickness of 10 μm on the polyethylene terephthalate film having a thickness of 5 μm, an ink ribbon was produced.

Then, the ink layer was heat transferred from the ink ribbon onto a sheet of paper.

EXAMPLE 12

In the same manner as in Example 1 except that the ink composition was coated at a dry thickness of 1 μm on the polyethylene terephthalate film having a thickness of 5 μm, an ink ribbon was produced.

Then, the ink layer was heat transferred from the ink ribbon onto a sheet of paper.

EXAMPLE 13

The following components were well mixed and charged in an aluminum crucible having a lid:

| Component | Parts |
|---|---|
| Molybdenum oxide ($MoO_3$) | 384.0 |
| Neodymium oxide ($Nd_2O_3$) | 101.0 |
| Ytterbium oxide ($Yb_2O_3$) | 13.1 |
| Calcium carbonate ($CaCO_3$) | 166.7 |

The crucible was heated from room temperature to 750° C. at a constant heating rate over 2 hours and sintered at 750° C. for 2 hours in an electric furnace.

After sintering, the crucible was removed from the electric furnace and cooled in an air. Then, hot water of 100° C. was poured in the crucible and boiled. Thereafter, a formed substance was recovered from the crucible and washed with water, followed by drying to obtain an infrared ray-emitting fluorescent substance, which had a particle size of 0.6 μm and a composition of $Nd_{1.8}Yb_{0.2}Ca_5(MoO_4)_8$.

The obtained infrared ray-emitting fluorescent substance (60 parts), bees wax (40 parts) and dodecylamine (5 parts) were molten and mixed to obtain an ink composition.

The ink composition was coated at a dry thickness of 1 μm on a polyethylene terephthalate film having a thickness of 5 μm and dried to form an ink layer and obtain an ink ribbon.

Then, the ink layer was heat transferred from the ink ribbon onto a sheet of paper.

EXAMPLE 14

In the same manner as in Example 3 except that the infrared ray-emitting fluorescent substance prepared in Example 13 was used, an ink ribbon was prepared.

Then, the ink layer was heat transferred from the ink ribbon onto a sheet of paper.

COMPARATIVE EXAMPLE 1

The following components were well mixed and charged in an aluminum crucible having a lid:

| Component | Parts |
|---|---|
| Ammonium dihydrogenphosphate [$(NH_4)H_2PO_4$] | 55.7 |
| Neodymium oxide ($Nd_2O_3$) | 16.2 |
| Ytterbium oxide ($Yb_2O_3$) | 2.2 |
| Lithium carbonate ($LiCO_3$) | 5.9 |

The crucible was heated from room temperature to 650° C. at a constant heating rate over 2 hours and sintered at 650° C. for 1 hour in an electric furnace.

After sintering, the crucible was removed from the electric furnace and cooled in an air. Then, hot water of 100° C. was poured in the crucible and boiled. Thereafter, a formed substance was recovered from the crucible and washed with 1N nitric acid and then with water, followed by drying to obtain an infrared ray-emitting fluorescent substance, which had a particle size of 2.0 μm and a composition of $LiNd_{0.9}Yb_{0.1}P_4O_{12}$.

The obtained infrared ray-emitting fluorescent substance was ground to a particle size of 0.6 μm.

Then, in the same manner as in Example 1 except that the above ground infrared ray-emitting fluorescent substance was used in place of the infrared ray-emitting fluorescent substance $Nd_{0.1}Yb_{0.1}Y_{0.8}PO_4$, an ink composition was prepared and an ink ribbon was produced.

Then, the ink layer was heat transferred from the ink ribbon onto a sheet of paper.

When the infrared ray-emitting fluorescent substance was ground, its particle shape became a needle shape, and the dispersing apparatus used in the preparation of the ink composition was severely damaged.

COMPARATIVE EXAMPLE 2

In the same manner as in Example 1 except that the ink composition was coated at a dry thickness of 0.05 μm on the polyethylene terephthalate film having a thickness of 5 μm, an ink ribbon was produced.

Then, the ink layer was heat transferred from the ink ribbon onto a sheet of paper.

COMPARATIVE EXAMPLE 3

In the same manner as in Example 1 except that the ink composition was coated at a dry thickness of 12 μm on the polyethylene terephthalate film having a thickness of 5 μm, an ink ribbon was produced.

Then, the ink layer was heat transferred from the ink ribbon onto a sheet of paper.

The ink layer on the ribbon was cracked and peeled off from the base film.

With an ink layer which was heat transferred onto a sheet of paper from each of the ink ribbon produced in Examples and Comparative Examples, an intensity of emitted light was measured.

The transferred ink layer was excited by a light having a wavelength of 810 nm and the emitted light was detected by a silicon photodetector having a peak sensitivity at 980 nm.

The intensity of emitted light was expressed as a relative value to that of the ink layer of Example 1 which was "100".

The results are shown in the Table.

TABLE

| Example No. | Intensity of emitted light |
|---|---|
| 1 | 100 |
| 2 | 115 |
| 3 | 97 |
| 4 | 110 |
| 5 | 98 |
| 6 | 112 |
| 7 | 82 |
| 8 | 84 |
| 9 | 80 |
| 10 | 96 |
| 11 | 108 |
| 12 | 80 |
| 13 | 85 |
| 14 | 90 |
| C.1 | 12 |
| C.2 | 40 |
| C.3 | 110 (peeled off) |

As seen from the results in the Table, the transferred ink layer from the ink ribbons of Examples 1–14 had higher intensities of emitted light than those from the ink ribbon of Comparative Examples 1–3. That is, the ink ribbon of the present invention has the high intensity of emitted light and is excellent in light emitting characteristics.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A ribbon comprising a base film and an infrared ray emitting layer having a thickness of from 1 to 10 μm, said infrared ray emitting layer containing infrared ray-emitting fluorescent particles having a size of at least 0.1 μm to less than 1 μm.

2. The ribbon according to claim 1, wherein said infrared ray-emitting fluorescent particles satisfy the formula:

$$A_{1-x-y}Nd_xYb_yPO_4$$

wherein A is at least one element selected from the group consisting of Al, Bi, B, In, Ga, Sc, Gd, Ce, Y, Lu and La, x is a number of 0 to 0.9, and y is a number of 0 to 0.9, provided that a sum of x and y is larger than 0 and not larger than 1.

3. The ink ribbon according to claim 1, wherein said infrared ray-emitting fluorescent particles satisfy the formula:

$$A_{2-p-q}Nd_pYb_qCa_5(MoO_4)_8$$

wherein A is at least one element selected from the group consisting of Al, Bi, B, In, Ga, Sc, Gd, Ce, Y, Lu and La, p is a number from 0 to 2, and q is a number from 0 to 2, provided that the sum of p and q is larger than 0 and not larger than 2, whereby said ink layer has light emitting characteristics.

4. The ribbon according to claim 1, wherein said ink layer further contains a dispersant selected from the group consisting of alkylamines and phosphate salts and mixtures thereof.

5. The ribbon of claim 4, wherein the dispersant is present in an amount of from 0.1 to 5% by weight, based on the weight of the infrared ray-emitting fluorescent particles.

6. The ribbon according to claim 1, wherein said infrared ray emitting layer further contains a colorant.

7. The ribbon of claim 1, wherein the infrared ray-emitting fluorescent particles are present in an amount of 60 to 85% by weight, based on the weight of the infrared ray emitting layer.

* * * * *